United States Patent [19]

Edwards

[11] 4,135,483

[45] Jan. 23, 1979

[54] FUEL FEED DEVICE

[76] Inventor: Frank A. Edwards, 42 Leeside Dr., Carmel, N.Y. 10512

[21] Appl. No.: 724,636

[22] Filed: Sep. 20, 1976

[51] Int. Cl.[2] ..... F02M 31/00

[52] U.S. Cl. ..... 123/133; 261/99

[58] Field of Search ..... 123/133; 261/95, 96, 261/99, 51; 55/257

[56] References Cited

U.S. PATENT DOCUMENTS

| | | | |
|---|---|---|---|
| 420,591 | 2/1890 | Dawson | 123/133 |
| 528,882 | 11/1894 | Keller | 261/99 |
| 550,776 | 12/1895 | Bourgeois | 123/133 |
| 583,818 | 1/1897 | Redman | 123/133 |
| 985,515 | 2/1911 | Dorman | 261/99 |
| 1,065,331 | 6/1913 | Rubesky | 261/99 |
| 1,097,039 | 5/1914 | Miller | 261/96 |
| 2,552,887 | 5/1951 | Demonet | 261/99 |
| 3,931,801 | 1/1976 | Rose | 123/133 |

*Primary Examiner*—Ronald H. Lazarus

[57] ABSTRACT

A fuel feed device is disclosed having a mixing chamber equipped with a plurality of liquid fuel absorbant members and means for admitting outside air into the chamber. Liquid fuel is supplied to the absorbant members and permitted to evaporate to form a mixture of gaseous vapors and air. This mixture is then conveyed through a vapor tank to the cylinders of an engine for combustion. The vapor tank is provided with means for recovering any gaseous vapors that condense back to liquid fuel and returning the liquid fuel to the fuel tank.

Means are also provided for regulating and controlling the liquid fuel supplied to the absorbant members and for regulating and controlling the gaseous vapors delivered to the engine cylinders.

11 Claims, 2 Drawing Figures

FUEL FEED DEVICE

This invention relates to a fuel-feed device for use with internal combustion engines.

BACKGROUND OF THE INVENTION

Various approaches have been made in efforts to obtain greater efficiency from the combustion of liquid fuels used in internal combustion engines. More recently, these efforts have also included means to reduce the amount of moxious or toxic exhaust gases.

For example, devices and apparatus have been suggested wherein part or all of the exhaust gases are recirculated to provide the heat to vaporize liquid fuel whereupon the liquid fuel thus vaporized is supplied to the manifold for subsequent combustion. These approaches are illustrated by U.S. Pat. No. 1,950,800 to J. A. Mathes, U.S. Pat. No. 2,749,223 to J. R. Harrington, U.S. Pat. No. 3,273,983 to C. Minoza, U.S. Pat. No. 3,886,919 to A. M. Freeman and U.S. Pat. 3,931,801 to W. J. Rose et al.

In some approaches, the vaporized fuel is passed through a carburetor prior to being supplied to the manifold for combustion such as are disclosed in U.S. Pat. No. 2,272,341 to G.L. Holzapfel and U.S. Pat. No. 2,306,897 to J. Ollig, while other approaches reveal the use of separate heating units to accomplish vaporization such as are disclosed in U.S. Pat. No. 2,853,988 to J. Perepolkin, U.S. Pat. No. 3,380,442 to A. O. Johnson, U.S. Pat. 3,411,489 to J. Kruger and U.S. Pat. No. 3,788,292 to S. Lee, Jr.

All of these approaches require either the use of a constant source supply of heat, or elaborate circulating and feed means for the liquid fuel and heat supply, or the addition of another component such as a heat exchanger to continuously supply heat, or the use of additional, separate elements to accomplish proper mixing of liquid fuel with vaporized fuel.

THE INVENTION

The fuel feed device of this invention is of simple construction, economical to produce and does not require the use of elaborate heat circulating systems or additional fuel feed means. In addition, the fuel feed device obviates the need for conventional carburetors and can be readily used with existing internal combustion engines requiring little or no structural modifications.

In general, the fuel feed device of the invention comprises a mixing chamber containing a plurality of liquid fuel absorbant members; means to supply liquid fuel to the absorbant members; means for admitting outside air into the mixing chamber; and, a vapor tank through which a mixture of gaseous vapors and air is passed to the cylinders of an engine for combustion.

The absorbant members serve as a storage means for the liquid fuel supplied to them and permit the liquid fuel to evaporate and then be mixed with incoming outside air. This gaseous vapor outside air mixture flows through the vapor tank which contains means for returning to the fuel tank any gaseous vapors that condense back into liquid fuel.

Means are also provided for regulating and controlling the liquid fuel supplied to the absorbant members and for regulating and controlling the flow of gaseous vapors delivered to the engine cylinders for combustion.

The device can be used with any type of liquid fuel having a low boiling point and acceptable for use with internal combustion engines such as gasoline, kerosene, alcohol, and the like.

THE DRAWING

The device of the invention will become more clear from the ensuing description when considered together with the accompanying drawing wherein a preferred embodiment of the device is illustrated and wherein.

Figure 1:
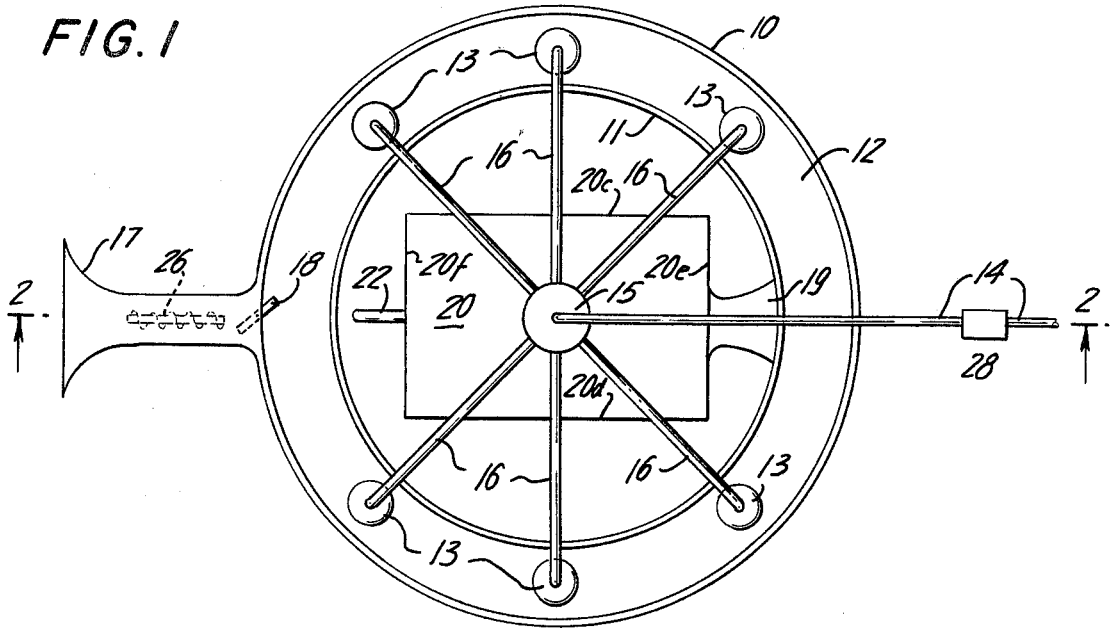
FIG. 1 is a plan view of the device without its cover.

As shown in the drawing, the fuel feed device comprises a circular outer housing member 10 and a circular inner housing member 11 positioned concentrically within and spaced apart from outer housing 10 to form a mixing chamber 12 therebetween. Within mixing chamber 12 are a plurality of liquid gas or liquid fuel absorbant members 13. These absorbant members 13 are preferably cylindrical and are mounted so that their vertical axes are parallel to each other and parallel to the axes of outer and inner housings 10 and 11, respectively.

Absorbant members 13 ca be provided from any suitable material that will absorb and retain the liquid fuel supplied to them so that they serve as a sponge-like storage area for the liquid fuel and yet permit the liquid fuel to evaporate from them. Accordingly, these members can be fabricated from various types of igneous rock, ceramics, open cellular metal alloys, and the like, provided the materials from which they are made are inert to the liquid fuel fed to them. Preferably, absorbant members 13 are made from pumis stone.

Generally, the number of absorbant members 13 to be used will be the same as the number of cylinders to be fired although two or more such members can be used for a single cylinder or a single absorbant member can be used for two or more cylinders.

Liquid gas or liquid fuel is supplied to the absorbant members 13 from a fuel tank by means of a conventional fuel pump (not shown) through main fuel line 14 which delivers the fuel to a liquid fuel diverter valve 15 and thence through auxiliary fuel lines 16 to absorbant members 13.

At one side of the device there is provided an air scoop 17 communicating with mixing chamber 12 through which outer air is admitted into the mixing chamber 12. Air scoop 17 is equipped with a one-way valve means such as a butterfly valve 18 which is normally open when the engine is running and normally closed when the engine is stopped.

Positioned generally opposite air scoop 17 on the other side of mixing chamber 12 is a vapor port 19 communicating with the mixing chamber 12 and with a vapor tank 20. Vapor port 19 serves as the conduit through which the gaseous vapors mixed with air are delivered to the vapor tank 20.

Vapor tank 20 has top, bottom, side and end walls **20*a*, 20*b*, 20*c*, 20*d*, 20*e* and 20*f*, respectively, and is preferably mounted within the space defined by the circumference of inner housing 11. This arrangement not only saves space, but also permits the mixture of gaseous vapors and air to flow quickly through the vapor tank 20 to the engine for combustion. Vapor port 19 communicates with mixing chamber 12 and vapor tank 20 through end wall 20*e* while a vapor fuel line 22 is connected to end wall 20*f* serves as the conduit for the flow of the gaseous vapors-air mixture to the engine cylinders. Within vapor tank 20 a plurality of baffle plates 21 (FIG. 2) are provided which are alternately, angularly disposed from the top and bottom walls 20***a* and 20*b*, respectively, of vapor tank 20 to form an interleafed arrangement. Thus, the fuel vapors mixed with air travel a serpentine path about baffle plates 21 to vapor fuel line 22 and thence to the engine cylinders for combustion.

Any vaporized fuel that condenses within vapor tank 20 is permitted to collect upon and then flow along the inclined bottom wall 20*b* of the vapor tank through weep ports 21*a* formed in those baffle plates secured to the bottom wall 20*b* and then into liquid gas trap 23. From liquid gas trap 23, the excess liquid gas is returned to the liquid fuel tank by means of liquid fuel return line 24.

Figure 2:
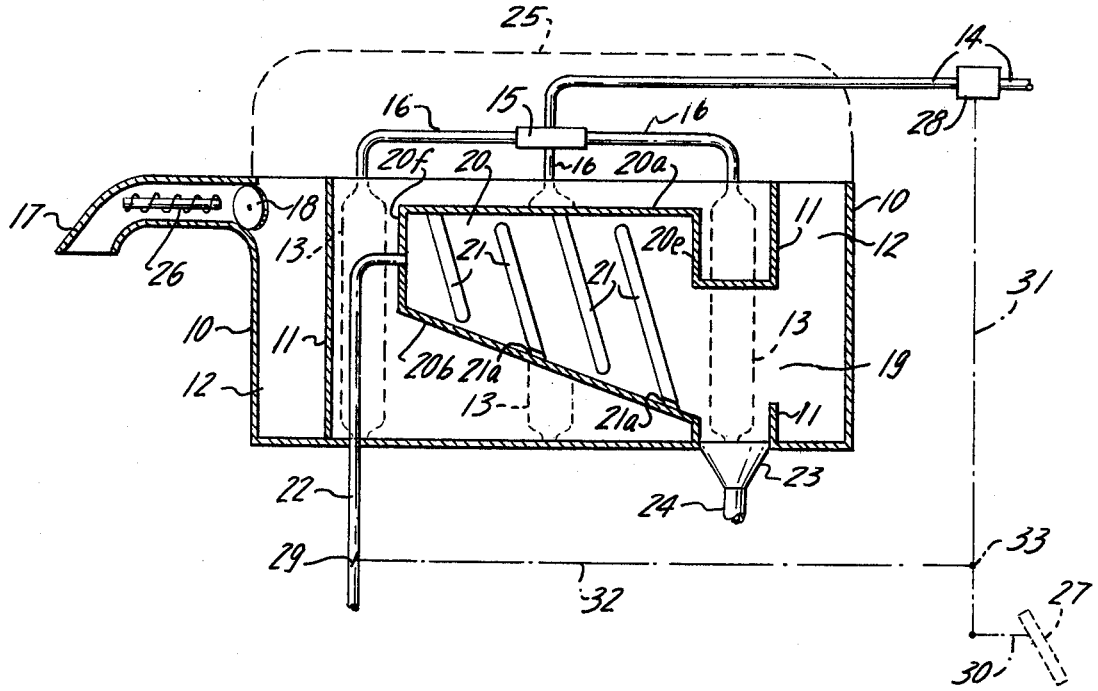
FIG. 2 is a view taken on the line 2—2 of FIG. 1.

Preferably, the device is enclosed and is provided with a removeable cover as shown in dotted line by reference numeral 25 (FIG. 2).

In some regions or under certain climatic conditions, the outside air entering through air scoop 17 into mixing chamber 12 may be too cool or too moist to readily evaporate the liquid gas stored in absorbant members 13 in sufficient amounts to assure a steady supply of gaseous vapors to the engine cylinders. To compensate for these conditions, a heater coil 26 can be positioned within air scoop 17 to either warm up and/or dehumidify the incoming air thereby enabling the liquid fuel to be readily vaporized. Heater coil 26 can be energized by means of the vehicle battery and actuated by appropriate sensing means such as a thermostat and/or a humidistat.

Proper feed of liquid fuel from the liquid fuel tank to the absorbant members as well as supply of gaseous vapors mixed with air from the vapor tank to the cylinders is provided by a suitable assemblage that can be controlled by means of the accelerator pedal of the vehicle. For example, the accelerator pedal, shown in broken line at 27, can be connected to a gas release valve 28 mounted aross main fuel line 14 and also be commonly connected to a choke valve 29 within vapor fuel line 22 by means of appropriate linkages shown in dot-dash lines at 30, 31 and 32. When the engine is not running, both the gas release valve 28 and the choke valve 29 are set to remain slightly open about 1%–5% of their fully opened capacity. When the engine is running, the degree to which both the gas release valve 28 and the choke valve 29 are opened will depend upon the degree to which accelerator pedal 27 is depressed. When gas release valve 28 is opened, it regulates the pressure flow of liquid gas through main fuel line 14 to the fuel diverter valve 15 and thence to auxiliary fuel lines 16 to assure that liquid fuel is delivered to each of the absorbant members 13 in the same quantity and at the same pressure. By connecting linkages 31 and 32 at a common point, as at 33, choke valve 29 is opened concurrently with gas release valve 28 to permit increased flow of gaseous vapors to the cylinders for combustion.

After the ignition key has been turned to the "on" position but prior to starting the engine, the accelerator pedal 27 is depressed thereby activating both the gas release valve 28 and the choke valve 29 to an initial, partially open position which is about 20% of the full open position of these valves. This permits initial feed of liquid fuel to begin to absorbant members 13 and concurrently begin initial flow of the gaseous vapors and air mixture to the engine cylinders.

After the engine has been started, gas release valve 28 and choke valve 29 will each maintain this initial open position until the accelerator pedal 27 is depressed again such as during normal use of the engine. When the engine is turned off, both the gas release valve 28 and the choke valve 29 automatically return to their slightly opened positions. Thus, when the ignition key has been turned to the "off" position, the accelerator pedal 27 can be depressed without "flooding" the engine.

As the engine is started and gaseous vapors mixed with air are supplied to the cylinders, a partial vacuum is created in vapor tank 20 thereby initiating the flow of outside air through air scoop 17 into and through the mixing chamber 12 and through vapor port 19 into vapor tank 20. The initial flow of outside air through air scoop 17 forces normally closed butterfly valve 18 to its open position. Butterfly valve 18 remains in its open position as long as the engine is running pulling outside air through air scoop 17.

The continuous flow of air increases the rate of evaporation of the liquid fuel contained in the absorbant members 13. The resultant mixture of air and gaseous vapors passes through vapor tank 20 and is delivered to the engine cylinders by means of vapor fuel line 22 for combustion. At the same time, liquid gas is being directly and continously supplied to the absorbant members 13 by means of the gas release valve 28, main liquid fuel line 14, fuel diverter valve 15 and auxiliary fuel lines 16 for continuous evaporation, thereby completing the cycle.

Except for the valve means used to regulate and control the flow of liquid gas and the air gaseous vapor mixture, the device has no moving parts that require repair or regular maintenance. Since the fuel delivered to the engine for combustion is a gaseous vapor, instantaneous and almost complete combustion of the fuel is realized resulting in a fuel efficiency of more than 95%. At this level of fuel combustion efficiency, noxious and/or toxic exhaust gases are reduced to such a degree that the use of costly anti-pollution devices are no longer required to meet current anti-pollution standards.

The size of the fuel feed device will generally depend upon the size of the engine to be serviced and the general size and shape of the absorbant members. Regardless of engine size, the absorbant members should each be capable of containing about 1–4 ounces of liquid fuel to ensure a steady and sufficient supply of gaseous vapors to the engine cylinders. When the absorbant members are cylindrical, they can accordingly be about 4.0" in height and have a diameter of about 2.0".

What is claimed is:

1. A fuel feed device for use with internal combustion engines, said fuel feed device comprising:

a mixing chamber;

a plurality of stationary, equi-spaced liquid fuel absorbant storage members mounted within said mixing chamber, said absorbant members being inert to the liquid fuel delivered to them;

a liquid fuel line for supplying liquid fuel to said absorbant members through a liquid fuel diverter valve;

a port for concurrently admitting outside air into said mixing chamber;

a vapor tank having means at one end thereof communicating with said mixing chamber and means at the other end thereof through which gaseous vapors are delivered to said engine for combustion, said vapor tank containing a plurality of baffle plate members about which said gaseous vapors travel before entering said engine;

a liquid fuel release valve for regulating and controlling the amount and pressure of the liquid fuel supplied to said absorbant members; and, a choke valve for regulating and controlling the flow of gaseous vapors to said engine.

2. The device of claim 1 wherein said liquid fuel supply means includes a plurality of auxiliary liquid fuel lines one end of each of which is connected to said diverter valve and the other ends of each of which are connected to said absorbant members.

3. The device of claim 1 wherein said outside air admitting means contains a one-way valve means that is normally closed when said engine is not running.

4. The device of claim 3 wherein said outside air admitting means also contains a heating element for warming and dehumidifying outside air admitted therethrough.

5. The device of claim 1 wherein said baffle plate members are alternately secured to the top and bottom walls of said vapor tank so as to suspend from said top wall and rise from said bottom wall in an interleafed arrangement.

6. The device of claim 5 wherein the bottom wall of said vapor tank is inclined with its lower end communicating with a gas trap, said gas trap having a liquid fuel return line for returning excess liquid fuel to said liquid fuel tank; and, the lower ends of said rising baffle plates having weep parts formed therein to permit excess liquid fuel to flow along said inclined bottom to said gas trap.

7. The device of claim 1 wherein said liquid fuel release valve is mounted across said liquid fuel supply means and is linked to an accelerator pedal for actuation thereof.

8. The device of claim 1 wherein said choke valve is mounted within said gaseous vapor delivery means and is linked to an accelerator pedal for actuation thereof.

9. A fuel feed device for use with internal combustion engines, said fuel feed device comprising:

a circular outer housing member and a circular inner housing member spaced from said outer housing member to form a mixing chamber therebetween;

a plurality of cylindrically shaped, equi-spaced liquid fuel absorbant storage members mounted within said mixing chamber, said absorbant members being inert to liquid fuel delivered to them;

a liquid fuel supply assemblage comprising a main liquid fuel line, one end of which is connected to a liquid fuel tank and the other end of which is connected to a liquid fuel diverter valve; and, a plurality of auxilliary liquid fuel lines, one end of each of which is connected to said diverter valve and the other ends of which are connected to the upper end of at least one of said absorbant members;

means for admitting outside air into said mixing chamber, said outside air admitting means containing a one-way valve means that is normally closed when said engine is not running;

a vapor tank having top, bottom, side and end walls, one end wall thereof having a vapor port communicating with said mixing chamber and the other end wall having a vapor fuel line secured thereto through which gaseous vaors are supplied from said vapor tank to said engine for combustion, the bottom wall of said vapor tank being inclined with its lower end communicating with a gas trap, said gas trap having a liquid fuel return line secured to its lower end through which excess liquid fuel is returned to said liquid fuel tank;

a plurality of baffle plate members within said vapor tank, said baffle plate members being alternately secured to the top and bottom walls of said vapor tank so as to suspend from said top wall and rise from said bottom wall in an interleafed arrangement, the lower ends of said rising baffle plates having weep ports formed therein to permit excess liquid fuel to flow therethrough along said inclined bottom wall to said gas trap;

a gas release valve mounted across said main liquid fuel line for regulating and controlling the amount and pressure of liquid fuel supplied to said absorbant members, said gas release valve being linked to an accelerator pedal for actuation thereof; and, a choke valve mounted within said vapor fuel line for regulating and controlling the flow of gaseous vapors to said engine, said choke valve being linked to said accelerator pedal for actuation thereof.

10. The device of claim 9 wherein said outside air admitting means includes a heating element for warming and dehumidifying outside air being admitted therethrough.

11. The device of claim 9 wherein the linkage for said gas release valve and the linkage for said choke valve are commonly connected to said accelerator pedal such that said gas release valve and said choke valve are concurrently actuated when said accelerator pedal is depressed.

* * * * *